US007003847B2

(12) United States Patent
Brown

(10) Patent No.: US 7,003,847 B2
(45) Date of Patent: Feb. 28, 2006

(54) DOOR CLOSER

(75) Inventor: Peter Edward Brown, Near Bridgnorth (GB)

(73) Assignee: Jebron Limited (GB)

( * ) Notice: Subject to any disclaimer, the term of this patent is extended or adjusted under 35 U.S.C. 154(b) by 83 days.

(21) Appl. No.: 10/268,607

(22) Filed: Oct. 10, 2002

(65) Prior Publication Data

US 2003/0093872 A1 May 22, 2003

(30) Foreign Application Priority Data

Oct. 11, 2001 (GB) ..... 0124376

(51) Int. Cl.
*B65B 57/00* (2006.01)

(52) U.S. Cl. ..... 16/53; 16/55; 16/56; 16/284; 16/58

(58) Field of Classification Search ..... 16/53, 16/55, 284, 56, 57, 58
See application file for complete search history.

(56) References Cited

U.S. PATENT DOCUMENTS 2,700,175 A * 1/1955 Carlson ..... 16/284
3,137,888 A * 6/1964 Blom ..... 16/51
3,246,362 A * 4/1966 Jackson ..... 16/51
3,724,023 A * 4/1973 Tillmann ..... 16/53
3,742,553 A * 7/1973 Sittmann ..... 16/55
4,064,589 A * 12/1977 Bejarano et al. ..... 16/53
4,349,939 A * 9/1982 Tillmann ..... 16/53
4,378,612 A * 4/1983 Beers ..... 16/62
4,414,703 A * 11/1983 Schnarr et al. ..... 16/52
4,785,493 A * 11/1988 Tillmann et al. ..... 16/53
4,793,023 A * 12/1988 Simpson et al. ..... 16/58
5,050,268 A * 9/1991 Toledo ..... 16/53
5,337,448 A * 8/1994 Brown ..... 16/53
5,417,013 A * 5/1995 Tillmann ..... 49/386
5,832,562 A * 11/1998 Luca ..... 16/71
6,260,236 B1 * 7/2001 Toledo ..... 16/53
6,397,430 B1 * 6/2002 Brown et al. ..... 16/71

* cited by examiner

*Primary Examiner*—Susan L. Barrett
*Assistant Examiner*—Mark Williams
(74) *Attorney, Agent, or Firm*—Webb Ziesenheim Logsdon Orkin & Hanson, P.C.

(57) ABSTRACT

A door closer comprising a housing, a member for driving engagement with a door, the member being rotatable relative to the housing in a door opening direction and in a door closing direction, a spring apparatus within the housing providing a resilient bias, the resilient bias being increased by rotation of the member in the door opening direction and a check device for controlling rotation of the member in the door closing direction and hence closure of the door under the action of the spring apparatus, the door closer having a back check comprising a piston member movable in a cylinder from an initial position against resistance of a fluid medium by rotation of the rotatable member in the opening direction.

14 Claims, 6 Drawing Sheets

DOOR CLOSER

FIELD OF THE INVENTION

This invention relates to a door closer, herein referred to as being of the kind described, comprising a housing, a member for driving engagement with a door, the member being rotatable relative to the housing in a door opening direction and in a door closing direction, a spring apparatus within the housing providing a resilient bias, the resilient bias being increased by rotation of the member in the door opening direction and a check device for controlling rotation of tie member in the door closing direction and hence closure of the door under the action of the spring apparatus.

BACKGROUND OF THE INVENTION

It is desirable to provide a back check device to resist opening of a door beyond a certain angle, for example, to prevent damage to a wall which could occur if unrestrained opening of the door were permitted.

An object of the present invention is to provide a door closer of the kind described with a new and improved back check.

SUMMARY OF THE INVENTION

According to the present invention we provide a door closer of the kind described having a back check comprising a piston member movable in a cylinder from an initial position against resistance of a fluid medium by rotation of the rotatable member in the opening direction.

Preferably a pair of piston members are movable in opposite directions in a respective chamber against resistance of a fluid medium by rotation of the rotatable member in the opening direction. This provides a compact back check.

The or each piston member may be movable in a direction which is tangential to the axis of rotation of the rotatable member.

The or each piston member may be movable by a cam follower which is engaged with a cam rotatable by rotation of said rotatable member.

Where there are two piston members the cam follower is disposed between the piston members.

Spring, biasing means may be provided to return the or each piston to said initial position.

The or each piston member may be engaged with a spherical intermediate piston member.

Where there are two piston members then, in a first plane, the cam follower is engaged by said intermediate piston members and by said cam to control movement of the cam follower in said plane whilst movement of the cam follower in directions out of the plane is controlled by walls of a passage of the housing from which the cam follower is disposed.

The fluid medium may be passed through a metering valve which permits a user defined rate of flow of fluid therethrough.

The metering valve may be settable to permit adjustment of the rate of flow of fluid therethrough.

The metering valve may be accessible from the exterior of the housing for said adjustment.

A door closing cam may be mounted in the housing for turning relative thereto with the rotary member, the door closing cam being acted upon by a spring-loaded door closing cam follower which is reciprocable relative to the housing along a main axis and which urges the door closing cam towards a door closed position.

The direction in which the or each back check piston member is movable may be transverse to said main axis. Preferably said transverse direction is at right angles to said main axis.

The piston members may be disposed on the opposite side of the axis of said rotatable member to said door closing cam follower.

By providing the piston members for the back check on the opposite side of the axis of rotation of the rotatable member to the door closing and check means by virtue of the transversely movable piston members described hereinbefore a relatively strong back check effect can be achieved without any need for increasing the resistance to opening of the door until the door is substantially open, for example, in excess of 90°.

BRIEF DESCRIPTION OF THE DRAWINGS

An example of a door closer embodying the present invention will now be described, with reference to the accompanying drawings, wherein:—

DESCRIPTION OF THE PREFERRED EMBODIMENTS

Figure 1:
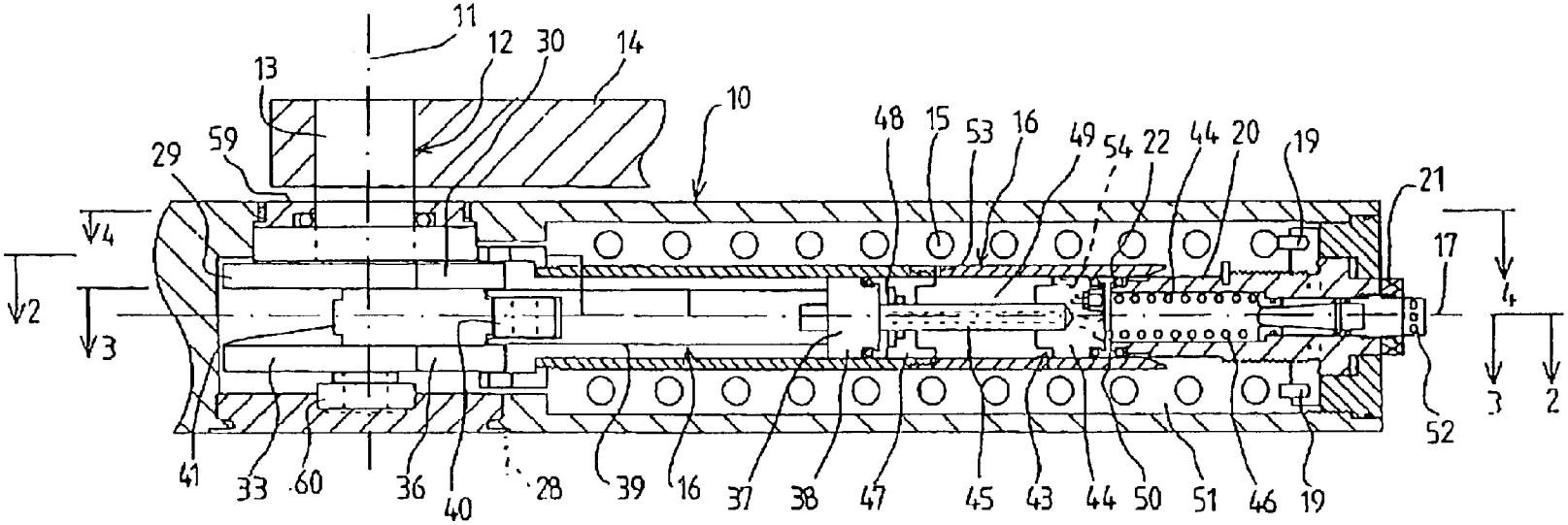
FIG. 1 is a fragmentary cross-section through a door closer in a vertical plane and with an operating member of the door closer in a rest position.

The device illustrated in the accompanying drawings comprises a hollow housing 10 in which there is mounted, by bearings 59, 60 for turning about an axis 11, a rotary member 12. An end portion 13 of the member 12 protrudes at the outside of the housing 10 and receives an arm 14, by means of which the rotary member 12 is connected with a door for turning with the door relative to the housing 10. Typically, the housing 10 is embedded in a floor and the door is supported for pivoting at the axis 11. The arm 14 may be attached to the bottom of the door and is typically received in a recess formed in the door. The end portion 13 is non-circular and is received in a complementary opening in the arm at one end thereof. When the door is opened the rotary member is rotated in a door opening direction and in a door closing direction when the door is closed.

There is disposed inside the housing 10 a coiled compression spring 15 and a drive mechanism for transmitting motion between the spring and the rotary member 12. The drive mechanism is arranged to compress the spring 15 when the door and member 12 are turned in a door opening direction from a rest position. The spring then urges the door and member 12 towards the rest position as a result of rotation of the member being caused in the door closing direction.

The drive mechanism includes three cam and follower mechanisms. The third cam and follower mechanism is essentially a duplicate of the first cam and follower mechanism. The followers of the first and third cam and follower mechanisms reciprocate relative to the housing 10 with a cylinder 16. The follower of the second cam and follower mechanisms reciprocates with a piston hereinafter described which slides inside the cylinder 16.

The device illustrated in the drawings is constructed to act as a check on damper and check on damp movement of the door towards the rest position under the action of the spring. It will be appreciated that, without the damping action, the door would be accelerated by the spring throughout movement towards the rest position, which would be unacceptably dangerous. In a case where the door is free to swing in either direction from the rest position, damping also enables the door to be brought to rest, when it reaches the rest position, rather than to pass through the rest position and then to oscillate about the rest position.

The cylinder 16 is mounted inside the housing 10 for reciprocation relative thereto along a main axis 17 of the cylinder. The main axis 17 extends centrally along the length of the housing 10 and either intersects the axis 11 or passes near to that axis. The cylinder 16 has at one end an enlarged, hollow head 18, on which there is formed a seat for one end of the spring 15. That part of the cylinder 16 other than the head 18 lies inside the spring 15. The spring extends beyond the cylinder 16 to a further seat 19, on which an end of the spring remote from the head 18 bears. The cylinder is open at both of its ends.

The seat 19 is mounted on a carrier 20 which is supported in one end portion of the housing 10 against movement outwards of the housing. The carrier 20 can turn relative to the housing about the main axis 17 and a non-circular end portion 21 of the carrier protrudes from the end of the housing to facilitate turning of the carrier by means of a suitable tool. The seat 19 is annular and has a female screw thread cooperating with a male screw thread on the carrier 20. The seat 19 is restrained against turning relative to the housing by the spring 15. This may be achieved by friction between the spring and the seat. Additionally, there may be formed on the seat 19 an axially projecting lug which cooperates with the spring to prevent turning of the seat relative to the spring. Accordingly, by turning of the carrier 20 relative to the housing 10, the seat 19 can be screwed along the housing to increase or decrease the stress in the spring 15.

The carrier 20 is integral with a fixed hollow piston 22 which slides inside the cylinder 16. The piston has an annular seal for bearing on the wall of the cylinder to establish an oil-tight relation between the piston and the cylinder. The piston 22 serves to guide the adjacent end portion of the cylinder 16 for movement relative to the housing along the main axis 17.

Figure 3:
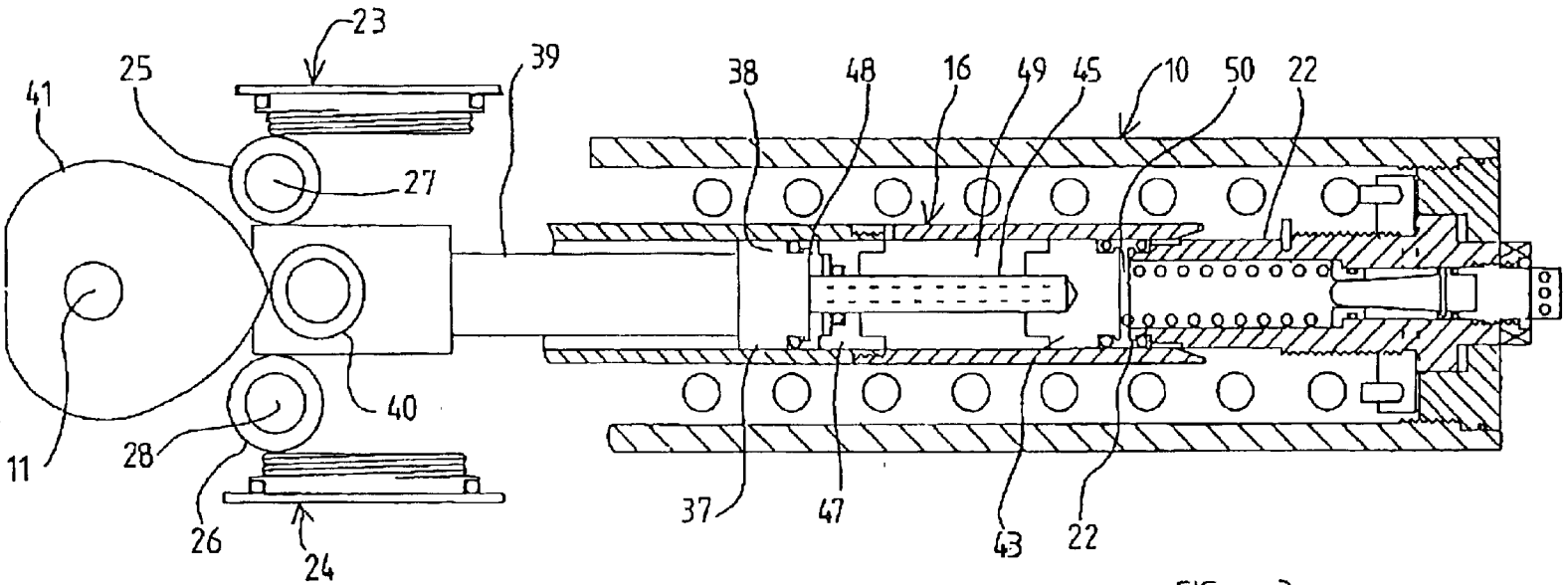
FIG. 3 is a representation similar to that of FIG. 2 but of a cross-section on the line 3—3 of FIG. 1.

Further guide means is provided for guiding the head 18 for movement along the main axis 17 relative to the housing 10. The further guide means is represented in FIG. 3 and comprises a pair of outer guide elements 23 and 24 incorporated in the housing 10 and a pair of inner guide elements 25 and 26 incorporated in the head 18 of the cylinder. The inner guide elements are formed as rollers and are mounted for free rotation relative to the head 18 about respective axes 27 and 28 which lie on opposite sides of the main axis 17, are equally spaced from that axis and are perpendicular to that axis. The roller axes 27 and 28 are parallel to the axis 11. The outer guide elements 23 and 24 have respective flat, mutually parallel faces on which the rollers 25 and 26 run.

A first cam 29 lies inside the housing 10, adjacent to the cylinder head 18, and is fixed with respect to the rotary operating member 12. The cylinder 16 is provided with a cam follower for cooperating with the cam 29. In the example illustrated, the cam follower is a roller 30 which engages the periphery of the cam 29. For transmitting force between the head 18 of the cylinder and the roller 30, there is provided a pair of rollers 31 and 32 mounted for free rotation relative to the head 18 about the axes 27 and 28. Thus, the axes of the rollers 31 and 32 are fixed with respect to the cylinder 16. The roller 30 is, however, free to undergo limited movement relative to the cylinder, although the roller 30 is trapped in the head 18.

The cylinder 16 is urged towards the axis 11 by the main spring 15. Accordingly, the rollers 31 and 32 are held in firm engagement with the cam follower roller 30 and the latter roller is held in firm engagement with the first cam 29. This relationship is achieved, irrespective of manufacturing tolerances and irrespective of normal wear of components which may occur during the service life of the device.

A second cam 33, only shown in FIG. 1, which is identical with the cam 29, is mounted in fixed relation to, but spaced along the axis 11 from, the first cam 29. The cylinder head 16 is provided with a further pair of rollers corresponding to the rollers 31 and 32 and mounted for rotation relative to the head about the axes 27 and 28 and with a further floating roller 36 corresponding to the floating roller 30, the roller 36 cooperating with the second cam and with the further pair of rollers in the same manner as that which the floating roller 30 cooperates with the first cam and with the rollers 31 and 32.

A first movable piston 37 is mounted inside the cylinder 16 for reciprocation relative thereto. The piston 37 comprises a head 38 bearing a spherical seat which cooperates with the wall of the cylinder and a piston rod 39 extending from the head 38 in a direction towards the axis 11. The piston rod 39 passes between the guide rollers 25 and 26 and is thereby guided for movement along the main axis 17. At its end remote from the head 38, the piston rod 39 carries a cam follower in the form of a roller 40. The roller 40 bears on the periphery of a third cam 41 interposed between the cams 29 and 33 and fixed with respect thereto.

A second possible piston 43 is also mounted in the cylinder 16 for reciprocator relative thereto. The second piston comprises a head 44 bearing a peripheral seal which cooperates with the wall of the cylinder and a piston rod 45 which extends from the head 44 in a direction towards the piston 37 and the axis 11. A coiled compression spring 46, which lies mainly inside the hollow piston 22 and which protrudes therefrom to the head 44 of the piston 43 urges the piston 43 towards the piston 37 and thereby urges the piston 37 towards the axis 11. This maintains the roller 40 in engagement with the periphery of the cam 41.

The cylinder 16 contains an annular plug 47 which lies between the piston head 38 and the piston head 44. This plug is fixed with respect to the cylinder and is sealed to the cylinder. For convenience of manufacture and assembly of components of the device, the cylinder may be formed in two parts, which meet at the plug 47. The plug may be employed to connect these parts of the cylinder together. The piston rod 45 extends through the plug 47 and is sealed with respect thereto by an annular seal mounted in the plug. The plug divides a first chamber 48 in the cylinder 16, lying between the piston head 38 and the plug, from a second chamber 49 lying between the plug and the piston head 44. A third chamber 50 inside the cylinder extends from the piston head 44 to the fixed piston 22 and includes the interior of that piston. Passages are provided for the flow of oil between these chambers and the space 51 outside the cylinder 16 which contains the main spring 15.

A passage providing communication between the third chamber 50 and the space 51 contains an adjustable needle valve 52. The needle valve is screwed into a threaded bore formed in the carrier 20 and a portion of the valve protrudes at the outside of the carrier 20, so that a tool can be applies to the needle valve to adjust the degree of construction of the flow path past the needle valve. The needle valve extends into an annular restrictor disposed in the central bore of the carrier 20. Lateral ports extend from this central bore to the space 51 at a position between the restrictor and the adjacent end of the housing 10.

A port 53 is formed in the cylinder 16 at a position between the plug 47 and the piston head 44. This port provides for relatively free flow of oil between the space 51 and the second chamber 49. A filter may be provided in the port 53 to prevent solid matter entering the cylinder. Communication between the second chamber 49 and the third chamber 50 is provided by a passage 54 formed in the piston head 44. This passage contains a non-return valve which permits flow in a direction from the second chamber to the third chamber but prevents flow through the passage 54 from the third chamber to the second chamber.

The third chamber 50 is in communication with the first chamber 48 via passages formed in the piston head 44 and the piston rod 45, which is hollow along its entire length. A recess is formed in that face of the piston head 38 which abuts the piston rod 45, to ensure free flow between the interior of the piston rod 45 and the first chamber 48.

Figure 5:
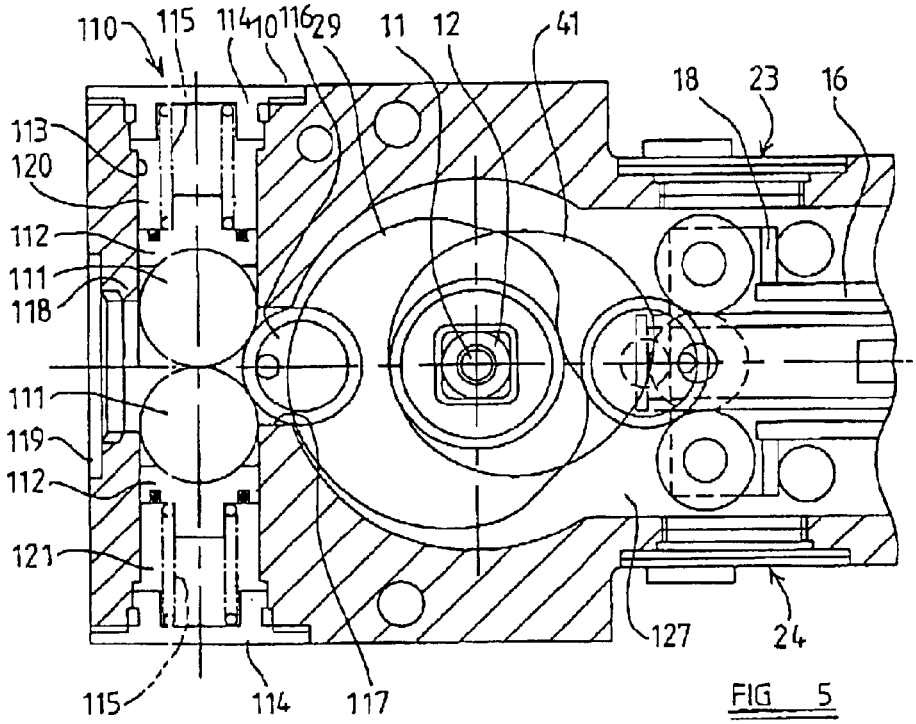
FIG. 5 is a diagrammatic plan view, partly in section, of the door closer of FIGS. 1 to 4 showing the components when the door has been opened 15°, from an "at rest" position.
Figure 6:
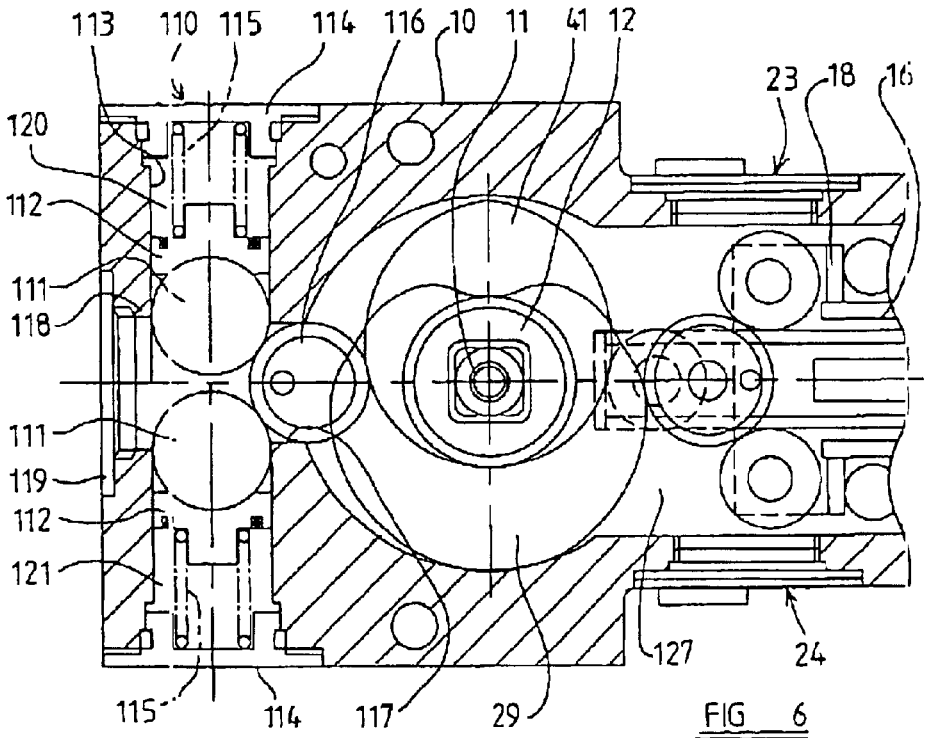
FIG. 6 is a view similar to that of FIG. 5 but when the door has been opened 90'.
Figure 7:
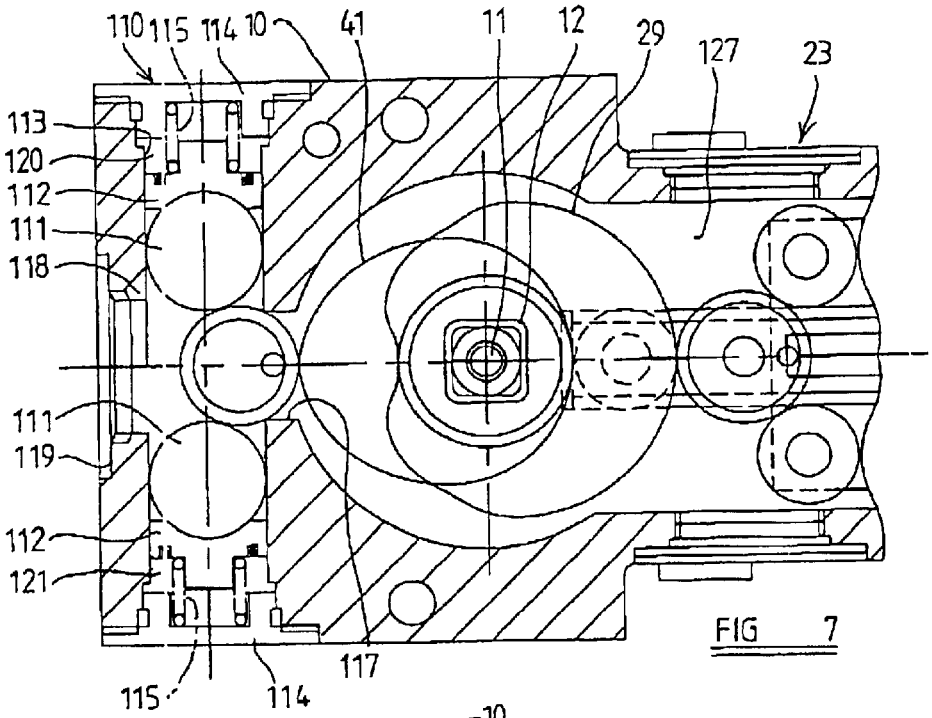
FIG. 7 is a view similar to that of FIG. 5 but when the door has been opened through 180°.

Referring now particularly to FIGS. 5 to 7. On the opposite side of the axis 11 to the cylinder 16 and the head 18 is provided a back check device indicated generally at 110. The device 110 comprises a pair of spherical intermediate piston members 111 which are received in plastic piston members 112 which, when engaged by the spherical members 111, are placed in a sealing engagement with the wall of a cylindrical cylinder 113 provided by a cross bore in the housing 10. The cross bore 113 is closed at opposite ends by threaded plugs 114 and a pair of coiled compression springs 115 are engaged between each plug 114 and the associated piston 112.

A cam follower 116 is received in a slot 117 formed in the housing 10 access being gained for machining purposes by an opening 118 which is closed after assembly of the device by a cylindrical plug 119. The cam follower 116 is controlled for movement in a plane containing the axis of the spherical members 111 and the cam 41 by engagement therewith whilst movement in a direction at right angles to the plane is effected by engagement of the cam follower 116 with upper and lower surfaces of the slot 117.

Figure 8:
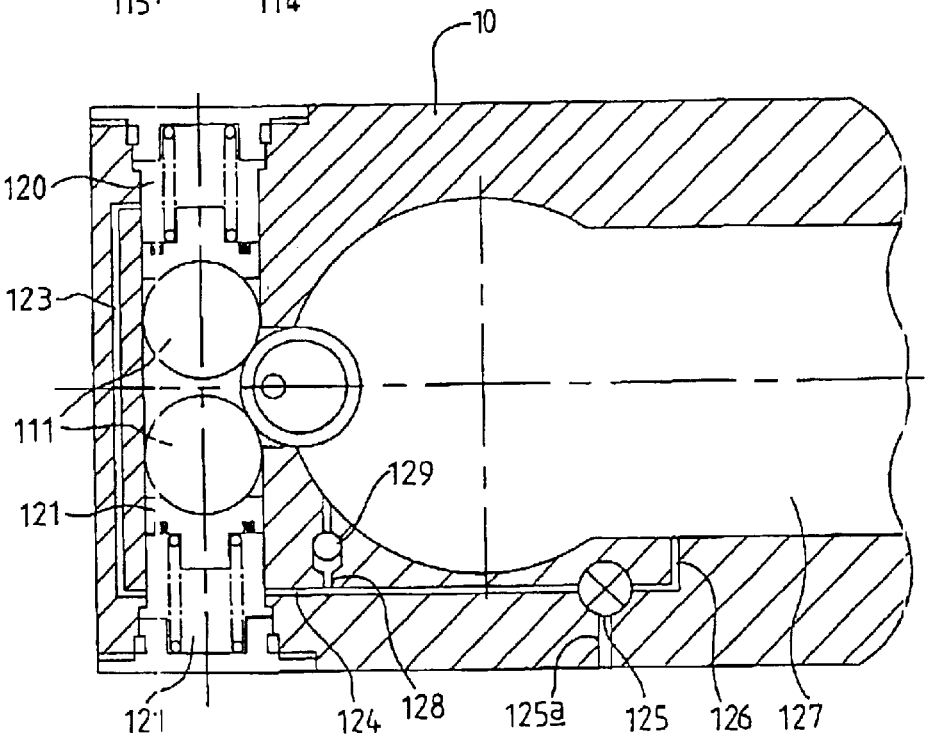
FIG. 8 is a view similar to that of FIG. 5 but to which certain internal passages have been added.

The piston members 112 engage in the cylinder 113 to form variable volume chambers 120, 121. Referring now to FIG. 8, the chamber 120 is connected by a passage 123 to the chamber 121. This chamber is connected by a passage 124 to a manually adjustable metering valve 125 which is connected by a passage 126 to the interior 127 of the housing 10. The valve 125 is accessible via a passage **125*a* in the housing to permit the user adjustment of the rate of flow of fluid therethrough. If desired, alternatively, the valve may have its rate of flow pre-set on assembly. In this case the passage 125*a* is not required. In addition the passage 124 is connected by a passage 128 to a non-return valve 129 which is in communication with the interior 127** of the housing.

Figure 2:
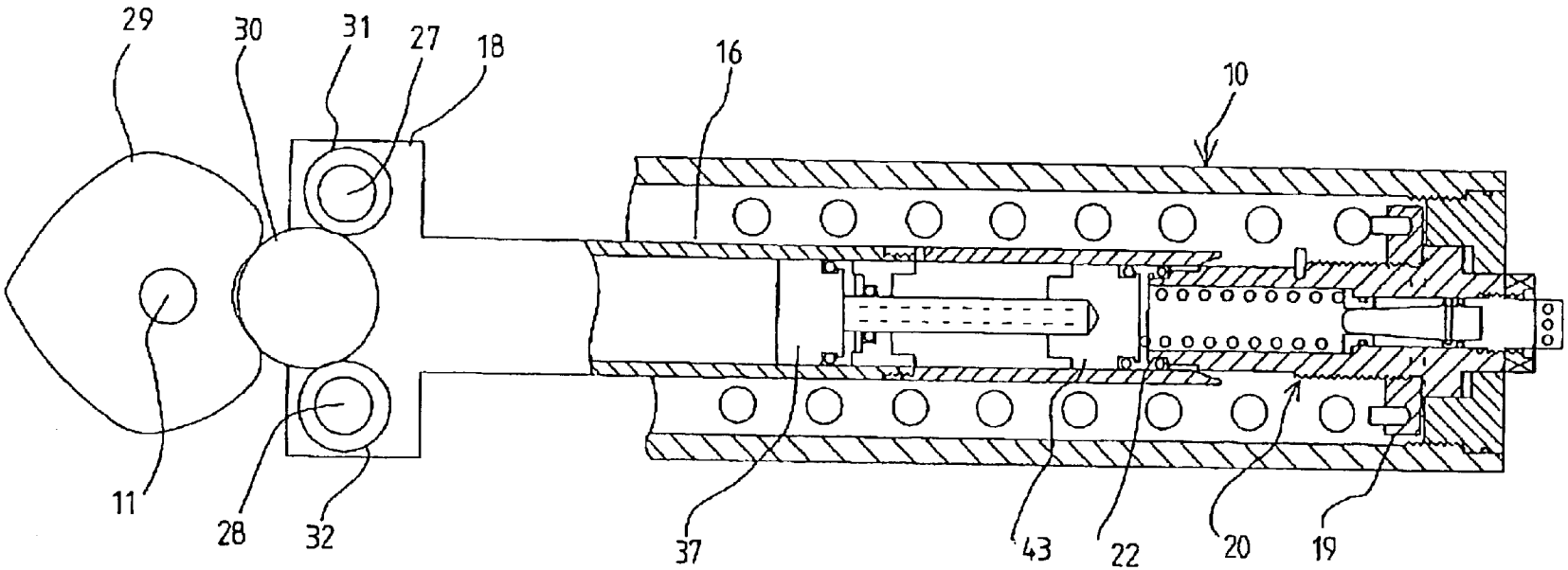
FIG. 2 is a diagrammatic representation of a cross-section through the door closer of FIG. 1 on the stepped line 2—2 of FIG. 1.

FIG. 2 illustrates the positions of the first cam 29, cylinder 16 and the pistons 22, 37 and 43, when the rotary member 12 is in a rest position relative to the housing 10. This is the position occupied when the main spring 15 is extended. It corresponds to the closed position of a door connected with the rotary member 12. FIG. 3 illustrates the position of the cam 41, guide rollers 25 and 26, the cylinder and the pistons also when the rotary member 12 is in the rest position. When the operating member is turned from the rest position, the cam 29 drives the floating roller 30 away from the axis 11, a small, initial, angular movement of the cam causing a relatively large displacement of the roller. Since the rollers 31 and 32 are held in firm engagement with the floating roller 30 and have respective axes which are fixed with respect to the cylinder 16, the cylinder is caused to move away from the axis 11 with the floating roller 30. Turning of the cam from the rest position drives the cylinder 16 away from the axis 11 and allows the piston 37 to move towards that axis. Movement of the cylinder away from the axis 11 compresses the main spring 15.

When the associated door is released, the spring 15 drives the cylinder 16 towards the axis 11. The cam and follower mechanism transmits motion from the cylinder 16 to the operating member 12 so that the door is swung towards the rest position. Turning of the operating member towards the rest position is yieldably opposed by the damping action of the device.

As the cam 41 is turned towards the rest position, it drives the roller 40 away from the axis 11. The piston head 38 is moved towards the plug 47 so that the volume of the first chamber 48 is reduced. Oil is expelled from that chamber along the interior of the hollow piston rod 45 to the third chamber 50. The piston 43 also is moved away from the axis 11 towards the fixed piston 22 so that the volume of the third chamber 50 also is reduced. Flow of oil from the third chamber to the second chamber 49 is prevented by the non-return valve in the passage 54. Accordingly, all of the oil expelled from the first chamber 48 and from the third chamber 50 must flow through the orifice restricted by the needle valve 52. Closing movement of the door is thereby controlled.

The shape of the cam 29 is selected to provide that the action of the floating roller 30 on the cam, when the operating member 12 is in the rest position, is a strong centering action, driving the came to and holding the cam in the rest position. The orientation of the cam relative to the housing 10, when in the rest position, can be adjusted through a small range by adjusting the outer guide elements 23 and 24 in a direction transverse to the axis 11. Adjustment of these guide elements 24 and 25 may be provided as described in GB-B-2261915.

Figure 4:
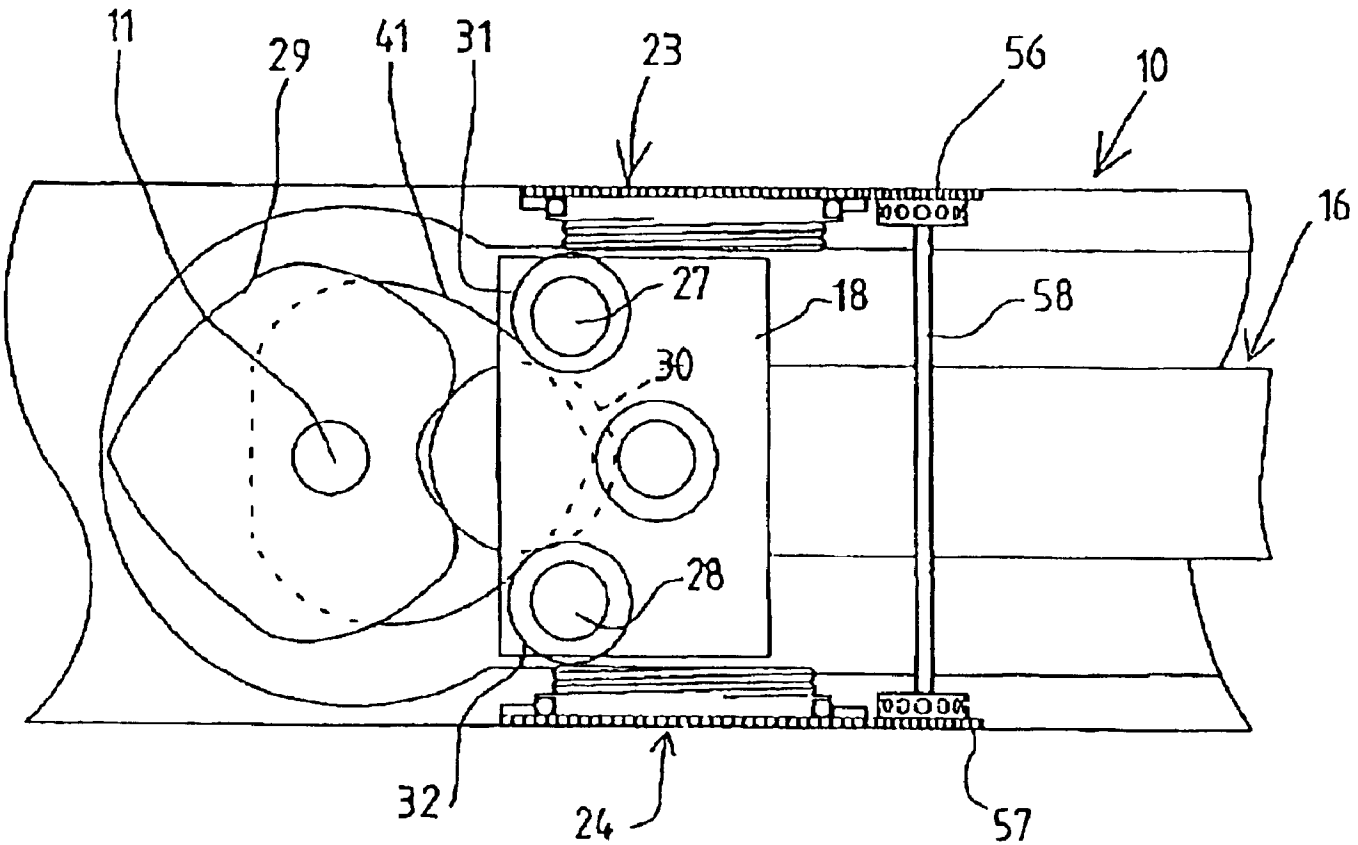
FIG. 4 is a fragmentary diagrammatic illustration of parts of the door closer as viewed in cross-section on the line 4—4 of FIG. 1.

Referring now particularly to FIGS. 5 to 7, when the door is first opened through a small angle, for example 15° as illustrated in FIG. 5, the cam follower 116 is not engaged by the cam 41 and so no movement of the spherical members 111 occurs and therefore there is no change in volume of the chambers 120, 121 and therefore no restriction on opening of the door. When the door is moved through 90° the cam follower 116 comes into engagement with the cam 41 initially; movement of the door beyond 90° causes relatively large movement of the cam follower 116 and hence large movement of the spherical members 111 along the cylinder 113. However as the door approaches the 180° position then, as best shown in FIG. 7, the cam follower 116 is progressively moved to the left in FIGS. 4 to 6 with consequent movement of the spherical members 111 along the cylinders 113 and consequential restriction in size of the chambers 120, 121. Fluid from these chambers is forced along the passages 123, 124 to the metering valve 125 which restricts the rate at which fluid can be discharged from the chambers 120, 121, therefore restricting the rate of movement of the spherical members 111 and so restricting the rate of movement of the cam follower 116 which has the effect of raising the torque required to open the door, thereby providing a back check effect which reduces in value as the door approaches 180° of movement.

When it is desired to close the door then normally it is simply released so that the door is returned to its initial position by the spring 15 as hereinbefore described. Such movement is permitted by oil being drawn into the chambers 120, 121 through the passage 128 via the valve 129.

Accordingly, the present invention provides a means of controlling the opening movement of a door beyond a predetermined angle, for example 90° to prevent damage to walls and furniture as a result of such opening movement being existent.

By providing the two separate piston and cylinder arrangements acting upon the cam following 116 a relatively great back check action can be provided without increasing the size of the housing beyond that necessary to achieve a proper closing action as the back check load required is split between two separate piston and cylinder arrangements.

In the present specification "comprises" means "includes or consists of" and "comprising" means "including or consisting of".

The features disclosed refer to a floor spring where space is restricted between the pivot point (axis 11) and the door frame. Typically, this distance is of the order of 70 mm. However, the features disclosed could equally apply to a surface mounted overhead closer if a compact back check system is required.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A door closer comprising a housing, a member for driving engagement with a door, the member being rotatable relative to the housing in a door opening direction and in a door closing direction, a spring apparatus within the housing providing a resilient bias, the resilient bias being increased by rotation of the member in the door opening direction and a check device for controlling rotation of the member in the door closing direction and hence closure of the door under the action of the spring apparatus, the door closer having a back check comprising a pair of piston members movable in opposite directions in a respective chamber against resistance of a fluid medium by rotation of the rotatable member in the opening direction.

2. A door closer according to claim 1 wherein the piston members are movable in a direction which is transverse to an axis of rotation of the rotatable member.

3. A door closer according to claim 1 wherein the piston members are movable by a cam follower which is engaged with a cam rotatable by rotation of said rotatable member.

4. A door closer according to claim 3 wherein the cam follower is disposed between the piston members.

5. A door closer according to claim 1 wherein spring biasing means are provided to return the piston members to said initial position.

6. A door closer according tol claim 1 wherein the piston members are engaged with a spherical intermediate piston member.

7. A door closer according to claim 1 wherein there are two piston members and, in a first plane, the cam follower is engaged by said intermediate piston members and by said cam to control movement of the cam follower in said plane whilst movement of the cam follower in directions out of the plane is controlled by walls of a passage of the housing from which the cam follower is disposed.

8. A door closer according to claim 1 wherein the fluid medium is passed through a metering valve which permits a predetermined rate of flow of fluid therethrough which may be user defined.

9. A door closer according to claim 8 wherein the metering valve is settable to permit adjustment of the rate of flow of fluid therethrough.

10. A door closer according to claim 9 wherein the metering valve is accessible from the exterior of the housing for said adjustment.

11. A door closer according to claim 1 wherein a door closing cam is mounted in the housing for turning relative thereto with the rotary member, the door closing cam being acted upon by a spring-loaded door closing cam follower which is reciprocal relative to the housing along a main axis and which urges the door closing cam towards a door closed position.

12. A door closer according to claim 11 wherein the direction in which the piston members are movable, is transverse to said main axis.

13. A door closer according to claim 12 wherein said transverse direction is at right angles to said main axis.

14. A door closer according to claim 13 wherein the piston members are disposed on the opposite side of the axis of said rotatable member to said door closing cam follower.

* * * * *

UNITED STATES PATENT AND TRADEMARK OFFICE

CERTIFICATE OF CORRECTION

PATENT NO. : 7,003,847 B2
APPLICATION NO. : 10/268607
DATED : February 28, 2006
INVENTOR(S) : Peter Edward Brown It is certified that error appears in the above-identified patent and that said Letters Patent is hereby corrected as shown below:

Column 8, Line 21, Claim 6, "according tol claim 1" should read
-- according to claim 1 --

Signed and Sealed this

First Day of August, 2006

JON W. DUDAS
*Director of the United States Patent and Trademark Office*